US005383346A

United States Patent [19]

Laffler et al.

[11] Patent Number: 5,383,346

[45] Date of Patent: Jan. 24, 1995

[54] ROLLER TUBE FOR AWNING AND METHOD OF FORMING

[75] Inventors: Ronald A. Laffler, Sturgis; Thomas DeVoursney, Muskegon, both of Mich.

[73] Assignee: White Consolidated Industries, Cleveland, Ohio

[21] Appl. No.: 249,240

[22] Filed: May 25, 1994

Related U.S. Application Data

[62] Division of Ser. No. 131,305, Oct. 4, 1993.

[51] Int. Cl.[6] ..... B21D 39/02

[52] U.S. Cl. ..... 72/51

[58] Field of Search ..... 72/51; 413/77

[56] References Cited

U.S. PATENT DOCUMENTS 697,955 4/1902 Thompson ..... 413/77

FOREIGN PATENT DOCUMENTS 490138 2/1953 Canada ..... 72/51

*Primary Examiner*—Lowell A. Larson

*Attorney, Agent, or Firm*—Pearne, Gordon, McCoy & Granger

[57] ABSTRACT

A galvanized and coated roll formed tube has several slideway channels formed therein. Edges of the sheet material forming the tube are folded back and interlocked in a hook arrangement to form a seam. The seam is located radially inwardly from the inner circumferential surface of the tube, preferably on a wall of one of the channels. Strengthening ridges are also formed in the tube. The tube is attached to an awning and supported at each end by poles or outriggers. The awning is also attached to a wall so as to be rollable around the tube.

5 Claims, 2 Drawing Sheets

ROLLER TUBE FOR AWNING AND METHOD OF FORMING

This is a division of application Ser. No. 08/131,305, filed Oct. 4, 1993.

BACKGROUND OF THE INVENTION

1. Field of the Invention

This invention relates generally to roll-up awnings for travel trailers or recreational vehicles, and in particular to a roller tube which forms the front of the awning assembly.

2. Description of the Related Art

It has long been recognized roll-up awnings have been useful in the recreational vehicle field. Such awnings are particularly useful when trailer homes or recreational vehicles are parked at a campsite. While parked, there is a need for a protected area in which users may take cover from inclement weather. A spring-biased, roll-up awning has long been used in the field.

A roll-up awning generally comprises a canopy connected at one end to the side of the recreational vehicle, and at the opposite end connected to a roller tube. The roller tube is pivotally supported by extended arms which are pivotally mounted to the side of the recreational vehicle. In a stored position, the canopy is rolled about the roller tube and secured to the recreational vehicle's side wall. When the awning is in use, the canopy is unrolled and is supported by the roller tube which is in turn supported by the extended side arms. In the unrolled position, the roller tube must not only support the weight of the canopy, but also the weight of other attachments (such as a screen or a valance), as well as resist the forces of nature (such as wind and rain). A roller tube, therefore, must be able to resist significant amounts of both normal force and bending stress.

In the past, when the awning was of long span, the roller tube would sag between its end supports. This situation was remedied by adding extra supports or by increasing the strength of the roller tube. One method of increasing the strength of a roller tube is to fabricate the tube from extruded aluminum. Extruded aluminum roller tubes have performed satisfactorily but are expensive to manufacture. Extruded steel roller tubes are also known in the art. However, because awnings are usually exposed to the elements, it is desirable to use steel which is electrogalvanized on both sides and specially coated for corrosion resistance. Extrusion does not permit the use of electrogalvanized or precoated steel. Furthermore, steel extrusion requires a steel having a lower yield strength than is suitable for awning support.

To reduce costs and improve performance, it is preferable to roll form the awning tube using a high strength material which is galvanized and painted prior to forming. Roll forming of aluminum is possible, but requires a softer and lower strength aluminum which is not adequate for awning support applications. Roll formed steel tubes are known which are welded or otherwise fastened. Typically, these use rivets or other elaborate means to fasten the awning to the tube. Roll formed tubes joined by welding at their seams are known. The weld or other fastener creates a bump in the rolled awning, tends to degrade the material and destroys corrosion resistant coatings.

Another non-extruded roller tube is shown in U.S. Pat. No. 4,258,778. The roller tube is fabricated from roll-formed steel and includes an injected plastic brace which increases the tube's resistance to bending forces. Such roller tubes are fabricated by folding and crimping the ends of the sheet metal together into a lock joint. The lock joint is located between slideways on the outer circumference of the roller tube. The placement of the lock joint on the circumference has been found to create problems of imbalance when the awning is being rolled out and rolled in. During rotation the tube has a greater deflection than is desirable. Twisting of the tube tends to cause relative axial sliding of the interlocking seam parts.

It is desirable, for corrosion resistance and aesthetic purposes, to have an awning assembly including a roller tube which is roll formed of previously galvanized, specially coated and painted steel. Such a roller tube reduces the awning's maintenance and increases its aesthetic value. The tube must have sufficient strength to support an awning and withstand other variable forces. Furthermore, its cross section should provide characteristics which properly balance the tube and minimize deflection during rolling and unrolling of the awning.

The object of the present invention is to provide a roll formed roller tube which is inexpensive to manufacture while providing the strength and balance characteristics required by current awning designs. The tube should be adaptable to a wide variety of spring loaded awnings, and can be incorporated into existing awning designs.

SUMMARY OF THE INVENTION

The present invention provides an awning having first and second ends, the first end being attachable to a wall and the second end being attached to a roller tube, the awning being rollable around the roller tube. The roller tube of rigid sheet material has two longitudinal edges. The sheet material is formed in an elongated, hollow, and generally cylindrical shape having an inner surface defining a circumference. The two longitudinal edges are joined at a seam, in an interlocking arrangement, and disposed radially inwardly from the circumferential surface.

A pair of hooks, preferably formed by the edges of the sheet being folded back on themselves, is disposed at the edges so as to interlock the edges to form the seam. At least one longitudinal channel, preferably a slideway, is formed in the sheet material of the roller tube. The seam is disposed in the channel, preferably so as to form a wall of the channel. The slideway has two sidewalls and a base wall, the seam being disposed on the base wall. Reinforcing ridges or grooves are also formed in the tube.

A method of forming a roller tube for an awning is also disclosed. A sheet of rigid material having two generally parallel longitudinal edges is roll formed into an elongated, generally cylindrical tube having an inner surface defining a circumference. The edges are folded back to form hooks disposed radially inwardly from the circumference. The hooks are engaged in an interlocking arrangement to form a seam which closes the tube.

A channel, preferably a slideway, is also formed in the tube, the seam being located in the channel. The channel is formed by bending one edge inwardly; bending the one edge back outwardly; and bending the other edge inwardly; and the seam is formed by bending one of the edges inwardly; folding back the other edge to form a hook; inserting the one edge into the hook; and folding back the one edge to form a second hook.

Prior to forming, the sheet is galvanized and a corrosion resistant coating is applied.

The present invention comprises a roller tube fabricated from roll-formed steel which is less expensive to manufacture than extruded aluminum and performs better than the prior art roll formed roller tubes. A finite element analysis comparing the performance of the present invention to the roller tube of U.S. Pat. No. 4,258,778 has demonstrated superior relative deflection of the invention during rolling.

It should be noted that while the present invention is specifically described as being utilized in travel vehicles it may be used in other awning installations.

DESCRIPTION OF THE PREFERRED EMBODIMENT

Figure 1:
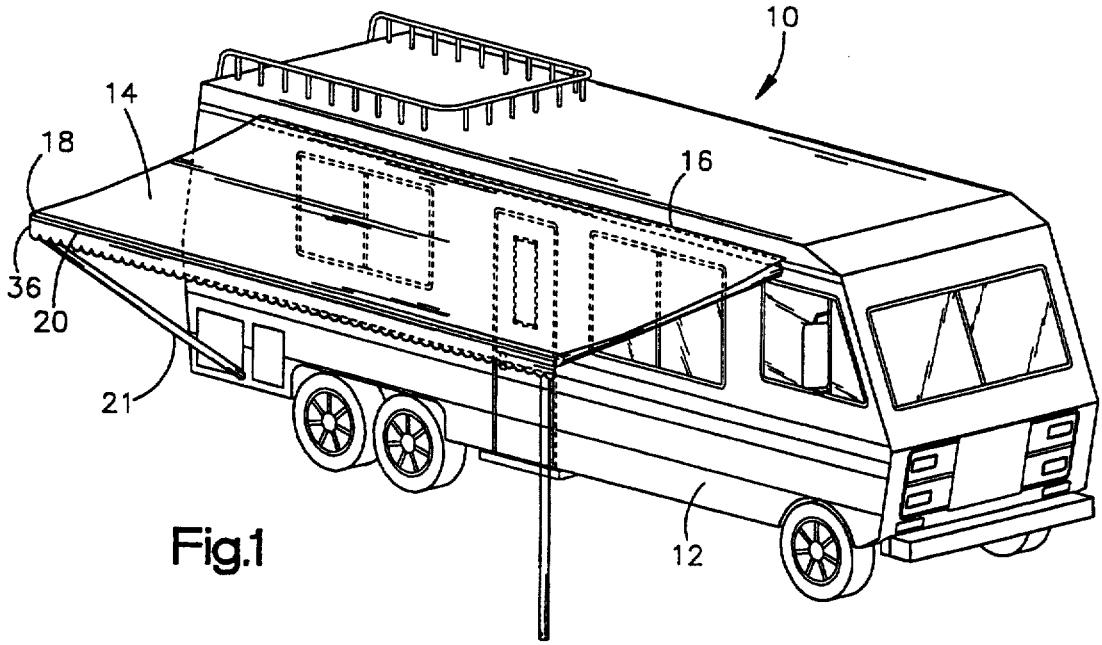
FIG. 1 shows an isometric view of a recreational vehicle equipped with an awning assembly according to the present invention.

Referring to FIG. 1, a vehicle 10, such as a camper or motor home, has a wall 12 which includes windows and a door, for example. An awning assembly for the vehicle includes an awning 14 having a first end 16 and a second end 18. The first end 16 is fixed to the wall 12 or other part of the vehicle by known means. In other embodiments, the wall could be part of a stationary building or other structure. The second end 18 of the awning is fixed to a roller tube 20. The tube 20 is supported at each end by a pole or outrigger 21 which engages the wall 12 or the ground near the wall 12.

Figure 2A:
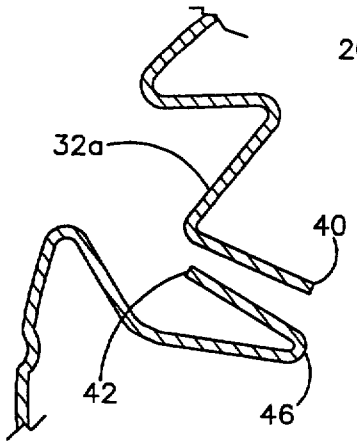
FIG. 2A is a detail view of a seam being formed according to the embodiment shown in FIG. 2.
Figure 2:
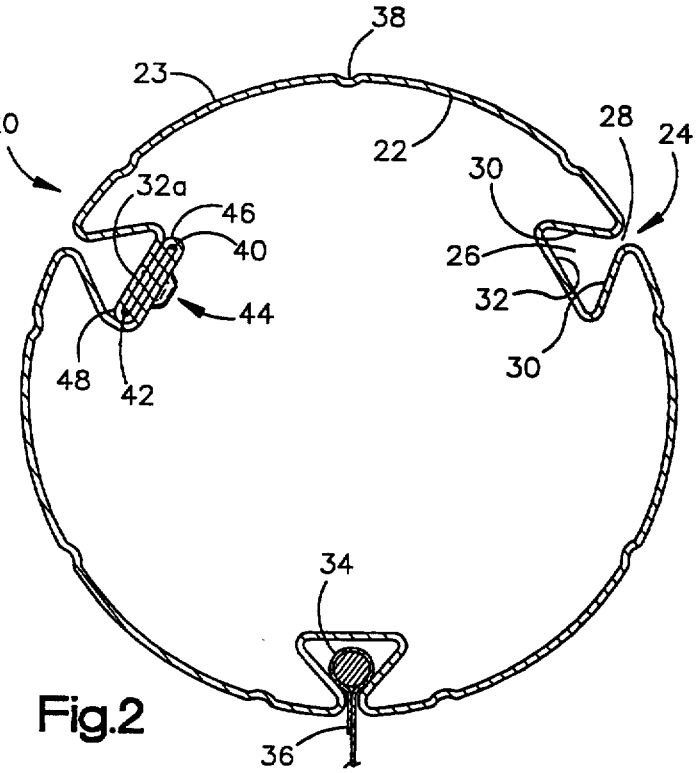
FIG. 2 shows a sectional end view of the roller tube.
Figure 3:
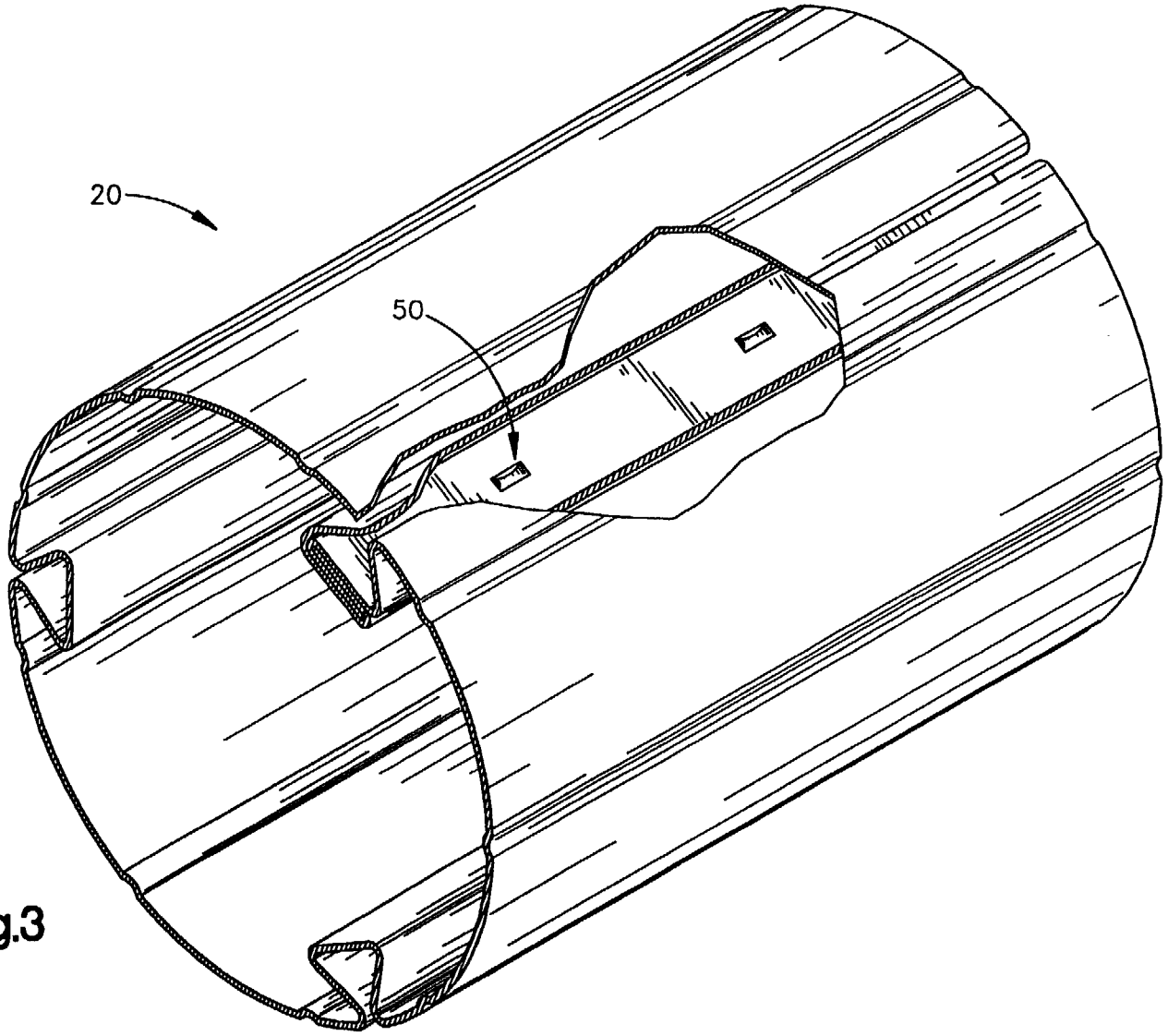
FIG. 3 shows an isometric view, partially cut away, of part of a roller tube according to the present invention.

Referring to FIGS. 2 and 3, the tube 20 is preferably made of steel having a yield strength between 40,000 and 60,000 pounds per square inch, galvanized and coated to resist corrosion. The tube 20 is a sheet of the steel material formed into a generally cylindrical shape to define an inner circumferential surface 22 and an outer circumferential surface 23. The generally cylindrical shape may comprise a plurality of flat sides forming an octagon or other multi-sided shape, for example. A plurality of slideways 24 are formed in the surface 22. Preferably, three slideways are symmetrically spaced around the circumference of the tube 20. Each slideway 24 defines a channel 26 having a longitudinal opening 28 which is narrower than the channel 26. The slideway channel 26 is defined by two side walls 30 and a base wall 32 arranged to form part of a trapezoid or triangle and adapted to receive a rod 34 or other sliding member. Alternatively, the channel 26 could be formed in another shape such as a rectangle or a semi-circle. The primary limitations on the shape of the slideway are that it should be adapted to receive a rod or similar element and have an opening 28 smaller than the channel. The slideways 24 are used to fasten the awning 14 and other objects such as a valance 36 or sliding hooks by known means. The tube 20 is adapted to have the awning 14 rolled around the outer circumference 23 of the tube so that the awning can be stored against the wall 12.

A plurality of longitudinal grooves 38 or ridges are formed on the outer surface 23 of the tube. These grooves 38 reinforce the tube and reduce deflection from sagging or bending of the tube. The grooves 38 or ridges 38 can be formed inwardly, outwardly or both and may be formed on one or both sides of the tube. The grooves 38 are preferably symmetrically spaced around the tube.

The first and second longitudinal edges 40, 42 of the sheet metal forming the tube 20, are joined to create a seam 44. The preferred embodiment of the seam 44, shown in FIG. 2A, is formed in the base wall of one of the slideways by bending the first edge 40 inwardly to about a 90° angle with respect to the base wall 32*a*. The second edge 42 is folded back 180° from a position extending radially inwardly so that it extends radially outwardly to form a first hook 46. The first edge 40 is inserted into the first hook 46 and folded back 90° to form a second hook 48 resulting in an interlocking engagement as shown in FIG. 2.

Crimps 50 or stakes are preferably formed at spaced apart locations in the seam 44. The crimps 50 are deformations, alternate protrusions and detents, of the generally planar surfaces of the seam which frictionally engage or interlock each other. The crimps resist relative sliding of the seam parts, in particular, axial sliding caused by twisting of the tube 20. The crimps can be formed by a crimping tool or other known means. Alternately, rivets or other mechanical fasteners can be used as stakes. The crimps are preferably located about five inches apart along the length of the tube.

Preferably the seam 44 is located so as to form the base wall 32a of one of the slideways. However, the seam could be located so as to form one of the side walls 30 of the slideway 24. Alternatively, the seam could be located in a channel that does not serve as a slideway, but is primarily provided as a location for the seam 44. The seam is located to form a wall of such a channel so that the seam is disposed radially inwardly from the inner circumferential surface 22 of the tube 20. The channel need not be adapted to receive a rod, but should be deep enough to have the desired balance characteristics. The channel in which the seam is disposed should be located equidistantly between slideways. Locating the seam inwardly from the inner circumference and locating the seam symmetrically with the slideway tends to improve the balance of the tube during rolling. Locating the seam separately from the slideway tends to improve strength at the expense of requiring an additional channel. According to the invention, locating the seam in a slideway or channel reduces the relative deflection of the tube during rolling and unrolling of the awning.

The tube 20 is roll formed from the sheet of steel or other suitable material according to the following method. The sheet is electrogalvanized, preferably with zinc, on both sides. One side of the sheet is then coated with a corrosion resistant paint, vinyl or other coating. Holes are drilled in the sheet as necessary. The sheet is then roll formed on a plurality of roll stands to form the sheet into a generally cylindrical shape with the coating on the outside. The grooves or ridges are formed at regularly spaced locations allowing material for forming the slideways. Each of the slideways 24 or channels is formed by bending the sheet at four places to form the open trapezoid shape. The channel in which the seam is to be located will have additional material for forming the hooks 46, 48, which are not yet folded. The edges 40, 42 of the sheet are folded back on themselves to form the hooks 46, 48, and the hooks are interlocked as described above. The hooks are then secured in interlocking engagement by a final bending or crimping operation to complete the channel. Finally, the seam 44 is staked or crimped 50 at one or more spaced apart locations to further interlock the seam. The material can be cut to length before or after the forming procedure.

According to this method a strong, corrosion resistant roller tube for an awning assembly is produced having superior rolling characteristics to prior art tubes. The tube is efficiently formed from precoated sheet material to provide a simple and effective awning assembly.

The present disclosure describes several embodiments of the invention, however, the invention is not limited to these embodiments. Other variations are contemplated to be within the spirit and scope of the invention and appended claims.

What is claimed is:

1. A method of forming a roller tube for an awning, comprising the steps of:

roll forming a sheet of rigid material having two generally parallel longitudinal edges into an elongated, generally cylindrical tube having an inner surface defining a circumference;

forming a channel in the tube by bending one edge inwardly to form a first side wall; bending the one edge back outwardly along a line closer to the one edge to form a base wall spaced radially inwardly from the inner circumference; and bending the other edge inwardly to form a second side wall; and forming a seam which closes the tube by bending the one edge inwardly; folding back the other edge to form a hook; inserting the one edge into the hook; and folding back the one edge to form a second hook so as to engage the hooks in an interlocking arrangement along the base wall.

2. A method according to claim 1, wherein the channel defines a slideway.

3. A method according to claim 1, further comprising the step of galvanizing the sheet prior to forming.

4. A method according to claim 1, further comprising the step of applying a corrosion resistant coating to the sheet prior to forming.

5. A method according to claim 1, further comprising the step of forming a plurality of longitudinal ridges in the tube.

* * * * *